US005250345A

United States Patent [19]

Chu

[11] Patent Number: 5,250,345

[45] Date of Patent: Oct. 5, 1993

[54] ANTI-SLIP DEVICE FOR A BELT

[76] Inventor: Chih-ming Chu, No. 25-4, Chueanchow Rd., Houli Hsiang, Taichung County, Taiwan

[21] Appl. No.: 839,932

[22] Filed: Feb. 21, 1992

[51] Int. Cl.[5] ..... B32B 3/00

[52] U.S. Cl. ..... 428/156; 428/167; 428/188; 2/305; 2/337; 2/268; 2/338

[58] Field of Search ..... 428/156, 167, 178, 188, 428/122, 120, 131, 136, 192, 212; 2/300, 305, 319, 337, 338, 268, 422

[56] References Cited

U.S. PATENT DOCUMENTS 4,151,320 4/1979 Naka ..... 428/167

5,147,705 9/1992 Ta-Shun et al. ..... 428/167

*Primary Examiner*—Donald J. Loney

*Attorney, Agent, or Firm*—Woodcock Washburn Kurtz Mackiewicz & Norris

[57] ABSTRACT

An anti-slip device for engagement on a belt including a body, and a pad formed integral on a bottom portion of the body and to be engaged on a shoulder of a user, the pad including a wedge-shaped cross section having a first side of larger thickness engaged on the outer portion of the shoulder of the user such that the belt is held horizontally and such that the pad is prevented from slipping off the shoulder.

4 Claims, 3 Drawing Sheets

ANTI-SLIP DEVICE FOR A BELT

BACKGROUND OF THE INVENTION

1. Field of the Invention

The present invention relates to an anti-slip device, and more particularly to an anti-slip device for a belt which carries an object, such as a baggage or a camera.

2. Description of the Prior Art

As shown in FIGS. 4 and 5, a typical anti-slip device includes a body 40 having a channel 41 formed therein and formed by such as two strips 42, and a belt 30 threaded through the channel 41 so that the body 40 can be engaged on the belt 30. The belt 30 is coupled to a bag 50 (FIG. 5) and can also be coupled to a baggage, a camera or other objects such that the objects can be easily carried. The body 40 is engaged generally on the shoulder of the user. However, the shoulder of the user generally inclined outward and downward of the user such that the body 40 is apt to be slipped off the shoulder of the user due to the weight of the object 50.

The present invention has arisen to mitigate and/or obviate the afore-described disadvantages of the conventional anti-slip devices.

SUMMARY OF THE INVENTION

The primary objective of the present invention is to provide an anti-slip device which can be stably supported on the shoulder of the user.

In accordance with one aspect of the invention, there is provided an anti-slip device for a belt carrying an object including a body including a channel formed in an upper portion thereof through which the belt is engaged, and a pad formed integral on a bottom portion of the body and to be engaged on a shoulder of a user, the pad including a substantially wedge-shaped cross section having a first side of larger thickness, the first side being engaged on an outer portion of the shoulder of the user such that the belt is held horizontally and such that the pad is prevented from slipping off the shoulder of the user.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
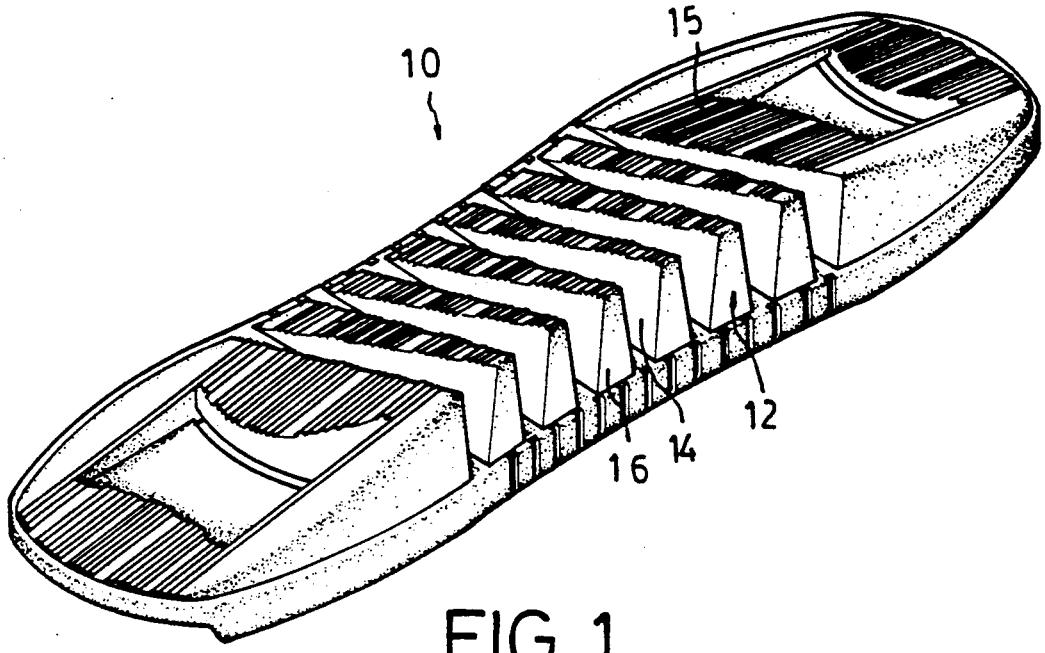
FIG. 1 is a bottom perspective view of an anti-slip device in accordance with the present invention.
Figure 2:
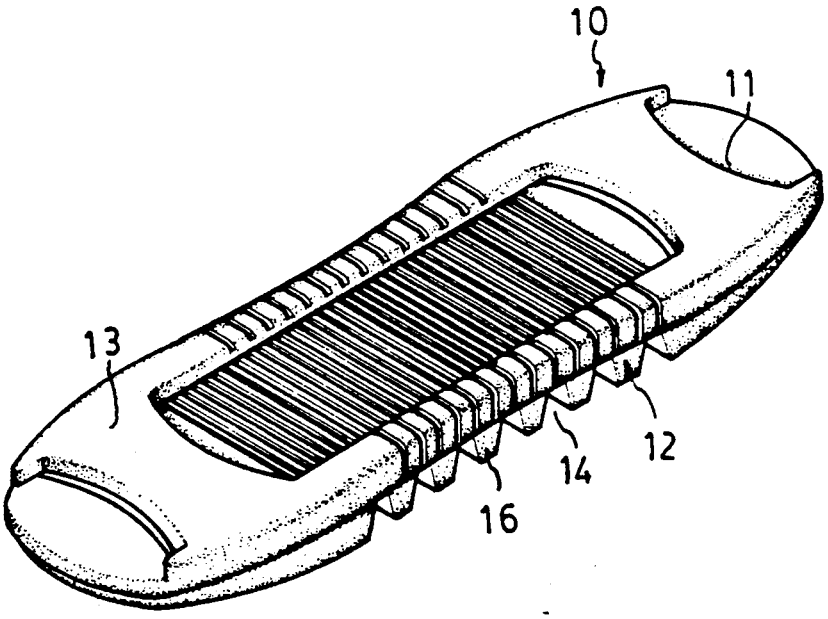
FIG. 2 is an upper perspective view of the anti-slip device.
Figure 3:
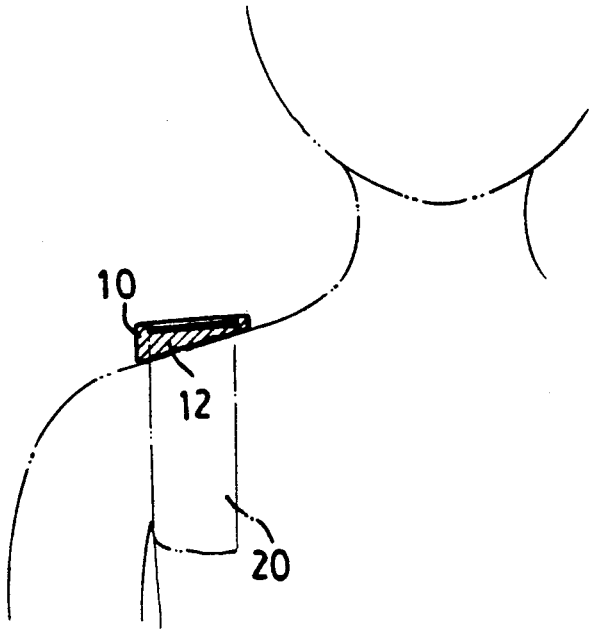
FIG. 3 is a schematic view illustrating the application of the anti-slip device.
Figure 4:
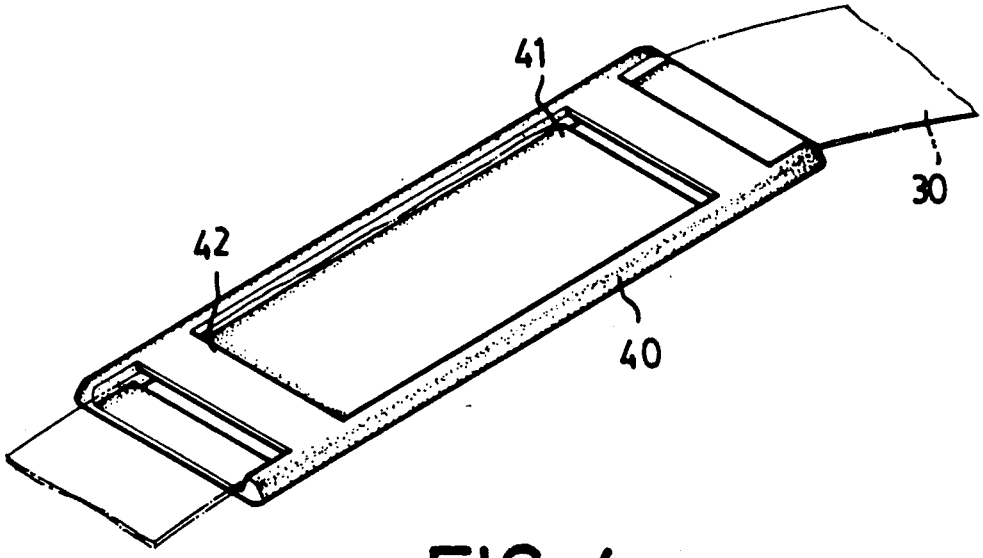
FIG. 4 PRIOR ART
FIG. 4 is a perspective view of a conventional anti-slip device.
Figure 5:
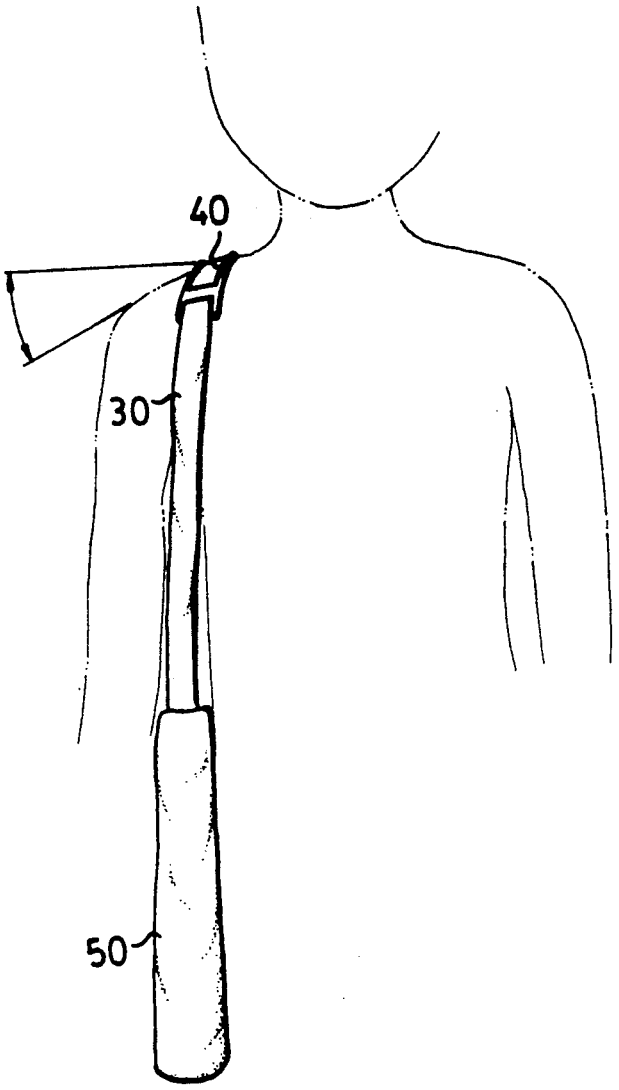
FIG. 5 PRIOR ART
FIG. 5 is a schematic view illustrating the application of the conventional anti-slip device.

Referring to FIGS. 1, 2 and 3, an anti-slip device in accordance with the present invention comprises generally a body 10 having a channel 11 formed in an upper portion thereof and formed by such as two spaced strips 13 such that a belt 20 can be threaded through the channel 11; and a pad 12 formed integral on the bottom portion of the body 10 and to be engaged on the shoulder of the user.

The pad 12 has a substantially wedge-shaped cross section and includes a first side of larger thickness, the first side of the pad 12 is arranged on the outer portion of the user such that the upper surface of the body 10 is substantially horizontal, best shown in FIG. 3. The pad 12 includes a plurality of parallel stripes 15 formed longitudinally on the lower surface thereof for engagement with the shoulder of the user in order to prevent the pad 12 from slipping off the shoulder of the user. The pad 12 further includes a plurality of grooves 14 laterally formed therein such that a plurality of ribs 16 are formed between the grooves 14 and such that the frictional coefficient of the pad 12 is further increased, and such that the pad 12 can further be prevented from slipping off the shoulder of the user.

Accordingly, the anti-slip device in accordance with the present invention includes a wedge-shaped pad 12 having a first side of larger thickness disposed on the outer portion of the user such that the pad can be prevented from slipping off the shoulder of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An anti-slip device for a belt comprising a body including a channel formed in an upper portion thereof through which said belt is engaged, and a pad formed integral on a bottom portion of said body and to be engaged on a shoulder of a user, said pad including a substantially wedge-shaped cross section having a first side of larger thickness, said first side being engaged on an outer portion of said shoulder of said user such that said belt is held horizontally and such that said pad is prevented from slipping off said shoulder of said user.

2. An anti-slip device according to claim 1, wherein said pad includes a plurality of stripes longitudinally formed thereon for engagement with said shoulder of said user, and a plurality of grooves laterally formed therein such that a plurality of ribs are formed between said grooves.

3. An anti-slip device for a belt comprising a body including a channel formed in an upper portion thereof through which said belt is engaged, and a pad formed integral on a bottom portion of said body and to be engaged on a shoulder of a user, said pad including a substantially wedge-shaped cross section having a first side of larger thickness, said first side being engaged on an outer portion of said shoulder of said user such that said belt is held horizontally and such that said pad is prevented from lipping off said shoulder of said user, said pad further including a plurality of grooves laterally formed therein such that a plurality of ribs are formed between said grooves.

4. An anti-slip device for a belt comprising a body including a channel formed in an upper portion thereof through which said belt is engaged, and a pad formed integral on a bottom portion of said body and to be engaged on a shoulder of a user, said pad including a substantially wedge-shaped cross section having a first side of larger thickness, said first side being engaged on an outer portion of said shoulder of said user such that said belt is held horizontally and such that said pad is prevented from slipping off said shoulder of said user, said pad further including a plurality of stripes longitudinally formed thereon for engagement with said shoulder of said user, and a plurality of grooves laterally formed therein such that a plurality of ribs are formed between said grooves.

* * * * *